US005893802A

United States Patent [19]

Böhme

[11] Patent Number: 5,893,802

[45] Date of Patent: Apr. 13, 1999

[54] AMUSEMENT RIDE SYSTEM WITH PASSENGER UNITS BEING MOVABLE UP AND DOWN

[75] Inventor: Karl Böhme, Bremen, Germany

[73] Assignee: Huss Maschinenfabrik GmbH & Co. KG, Bremen, Germany

[21] Appl. No.: 08/993,762

[22] Filed: Dec. 18, 1997

[30] Foreign Application Priority Data

Dec. 19, 1996 [DE] Germany ..... 296 21 944

[51] Int. Cl.[6] ..... A63G 31/10

[52] U.S. Cl. ..... 472/131; 472/2

[58] Field of Search ..... 472/2, 50, 131, 472/49, 39; 434/59, 30

[56] References Cited

U.S. PATENT DOCUMENTS

| | | | |
|---|---|---|---|
| 1,991,459 | 2/1935 | Heimers . | |
| 2,221,215 | 11/1940 | Eyerly . | |
| 2,229,201 | 1/1941 | Williford et al. . | |
| 2,965,375 | 12/1960 | Hamilton . | |
| 3,587,397 | 6/1971 | Hagopian . | |
| 3,701,528 | 10/1972 | Ryan . | |
| 3,745,888 | 7/1973 | Boretti . | |
| 3,885,503 | 4/1974 | Barber . | |
| 3,949,953 | 4/1976 | Hopkins . | |
| 4,487,410 | 12/1984 | Sassak . | |
| 4,545,574 | 10/1985 | Sassak . | |
| 4,973,042 | 11/1990 | Klopf et al. | 472/2 |
| 4,997,060 | 3/1991 | Sassak . | |
| 5,046,719 | 9/1991 | Comstock et al. | 472/49 |
| 5,087,037 | 2/1992 | Morrow . | |
| 5,203,744 | 4/1993 | Checketts . | |
| 5,417,615 | 5/1995 | Beard . | |
| 5,447,211 | 9/1995 | Sors . | |
| 5,597,358 | 1/1997 | Marcu . | |
| 5,628,690 | 5/1997 | Spieldiener et al. | 472/131 |
| 5,632,686 | 5/1997 | Checketts . | |
| 5,704,841 | 1/1998 | Checketts . | |

FOREIGN PATENT DOCUMENTS

| | | |
|---|---|---|
| 364 621 | 11/1981 | Austria . |
| 0 707 875 | 4/1996 | European Pat. Off. . |
| 616 245 | 5/1926 | France . |
| 1 293 037 | 4/1969 | Germany . |
| 24 04 244 | 8/1975 | Germany . |
| 2 211 607 | 4/1976 | Germany . |
| 39 14 889 | 11/1990 | Germany . |
| Wo 96/07459 | 3/1996 | WIPO . |

*Primary Examiner*—Kien T. Nguyen
*Attorney, Agent, or Firm*—Merchant, Gould, Smith, Edell, Welter & Schmidt, P.A.

[57] ABSTRACT

A ride system having a frame (6), at least one passenger carrier (8) which for altering its height is guided along the frame (6) between an upper end position II and a lower end position I, a cable or chain pull (12) which at its first end (12*a*) is fastened to the passenger carrier (8) and is deflected round a first roller (14) supported on the frame (6) so that the passenger carrier (8) is suspended from the first roller (14) by means of the cable (12) or chain, and a driving mechanism (24, 26, 36, 44) to drive the cable or chain pull (12) for raising the passenger carrier (8) from its lower end position, (I) up to its upper end position (II). The special feature consists in the provision of at least one second roller (16) which may be moved and driven by the driving mechanism (34, 26, 36, 44) essentially transversely to its axis of rotation, the cable (12) or chain running from the first roller (14) to the second roller (16), there becoming deflected and being fastened by the second end (12*b*) to a point of attachment (18) on the frame (6).

35 Claims, 3 Drawing Sheets

AMUSEMENT RIDE SYSTEM WITH PASSENGER UNITS BEING MOVABLE UP AND DOWN

FIELD OF THE INVENTION

The invention is concerned with a ride system having a frame, at least one passenger carrier which for altering its height is guided between an upper end position and a lower end position, a cable or chain pull which at its first end is fastened to the passenger carrier and is deflected round a first roller supported on the frame so that the passenger carrier is suspended from the first roller by means of the cable or chain, and a driving mechanism to drive the cable or chain pull for raising the passenger carrier from its lower end position up to its upper end position.

BACKGROUND OF THE INVENTION

A ride system of that kind is known, for example, from the WO 96/07459. In the case of this known ride system the driving mechanism consists of a motor driven cable winch which is seated at the top end of the tower frame and over which a cable pull is led in a number of turns.

The passenger carrier is suspended from the first end of the cable pull and a counterweight from the second end. Again, a coupling is provided for carrying along and releasing the passenger carrier. By means of the driving mechanism the passenger carrier is raised by motor from its lower end position into its upper end position and released in its upper end position by the coupling so that it returns thence in free fall down the frame again into its lower end position. In the lower region of the drop there is a braking arrangement in constant readiness for braking, by which the free-fall motion of the passenger carrier is brought to rest.

A similar ride system is described in the U.S. Pat. No. 2,229,201, though here the cable carrying the passenger carrier is wound up completely to the motor driven cable winch.

The U.S. Pat. No. 3,885,503 is concerned with a similar ride system in which, however, the passenger carrier is guided along an endless rail between its lower end position and its upper end position. Here an endlessly circulating cable or chain pull is also employed to correspond, which is driven over rollers or gearwheels by a driving mechanism. The passenger carrier is engaged with the endlessly circulating motor-driven cable or chain pull and after reaching its upper end position is detached from it for only some of the way during its succeeding downwards motion for the generation of a free fall motion, before in the lower region of the drop it is braked by a brake mechanism and brought into engagement again with the circulating cable or chain pull.

But a disadvantage of the ride systems described above is that during the upwards motion of the passenger carrier no significant acceleration can be achieved by means of the driving mechanisms employed there.

From the EP 0 707 875 A1 a ride system of the kind named initially is also known in which the driving mechanism is formed by a pneumatic cable pull cylinder. Whilst the passenger carrier is attached to the first end of a cable, the second end of the cable, after deflection round the first roller, is led through a seal to the head of the compressed air cylinder and fastened to the piston supported to slide in the latter, so that the cable carrying the passenger carrier forms by its second end the cable pull of the piston of the pneumatic cable-pull cylinder. With such a driving mechanism comparatively high accelerations may be achieved during the upwards motion of the passenger carrier so that this known ride system imparts the sensation of a "blast-off".

SUMMARY OF THE INVENTION

By the driving mechanism employed in this ride system a significant acceleration may indeed be generated during the upwards motion of the passenger carrier, but the known driving mechanism is very voluminous and needs a lot of room, which not only has a negative effect upon the structure of the ride system but also in the case of a transportable execution makes handling more difficult during erection and dismantling.

The problem of the present invention is therefore to improve the ride system named initially, with an arrangement which allows a driving mechanism of comparatively small construction to be chosen, which at the same time generates the desired acceleration during the upwards motion of the passenger carrier.

This problem is solved because with a ride system of the kind named initially, at least one second roller is provided, which may be moved and driven by the driving mechanism essentially transversely to its axis of rotation, the cable or chain running from the first roller to the second roller, there becoming deflected and being fastened by the second end to a point of attachment on the frame.

The advantage of the arrangement in accordance with the invention consists in a gearing-down being created in the cable or chain pull, whereby a driving mechanism of smaller construction may be employed, but at the same time the desired higher acceleration may be achieved during the upwards motion of the passenger carrier. The arrangement in accordance with the invention is therefore very effective and furthermore because of the small construction allowed, allows simpler handling in the case of a transportable execution.

For generating a motion in free fall during the downwards movement of the passenger carrier, a release mechanism for releasing the passenger carrier is preferably provided, which usefully releases the second roller.

In order during downwards movement of the passenger carrier to arrive in the free fall motion as quickly as possible after leaving the upper end position, there should furthermore for accelerating the passenger carrier be an accelerator mechanism which usefully accelerates the second roller correspondingly along its travel for the downwards movement of the passenger carrier.

Not merely for safety reasons a brake mechanism should also be provided for braking the passenger carrier during its downwards movement, so that the passenger carrier comes to rest in its lower end position. For doing this the brake mechanism should usefully brake the second roller correspondingly along its travel for the downwards movement of the passenger carrier. Should the brake mechanism be provided as an emergency brake mechanism or should such a brake mechanism be provided in addition, it should work independently of the driving mechanism.

In order to guarantee that the second roller move along a desired travel, that is, naturally reciprocally, it should in addition be supported on a guide-cage which is guided on the frame.

Preferably for altering the height of the second roller it is supported on the frame to be movable between a lower and an upper end position, the first roller and the point of attachment of the cable also being usually arranged above the upper end position of the second roller. In this case the travel of the second roller should usefully run essentially in parallel with that of the passenger, the first roller and the point of attachment of the cable be arranged adjacent to the upper end position of the passenger carrier, and the stroke of the passenger carrier be about twice the height of that of the second roller. With this execution an especially compact and at the same time effective construction may be realized.

The construction in accordance with the invention preferably allows the arrangement of the driving mechanism in the lower portion of the frame. It is thereby possible to keep the centre of gravity of the whole ride system as low as possible and to make the upper portion of the frame as light in weight as possible, so that the stability of the ride system remains guaranteed even under higher wind loadings, especially when the frame is made as a tower.

A particularly transportable execution preferred in this respect, in which the frame is subdivided into a lower half and an upper half and the lower and upper halves are connected detachably together, is distinguished in that the driving mechanism is arranged in the lower half.

The second roller is then usefully guided to be movable in the upper half of the frame and may be uncoupled from the driving mechanism. Such a construction allows particularly simple handling during erection and dismantling of the ride system.

Another execution particularly preferred at present, in which the driving mechanism exhibits a pressure-fluid cylinder with a piston supported to slide in it, is distinguished by the piston being provided with a pistonrod which is coupled mechanically to the second roller. Consequently with this preferred execution an ordinary pressure-fluid cylinder is employed, the piston of which is provided with a pistonrod, so that the transfer of load is effected over the pistonrod. Compared with a traction-cable cylinder like that used, for example, in the case of the ride system in accordance with the EP 0 707 875, such a pressure-fluid cylinder has the advantage of simpler sealing. That is, not merely because of the high speed and the flexibility of the cable, it has been found that the seal in the outlet opening of the cylinder, through which the cable is guided, undergoes a comparatively high wear. Compared to that a pistonrod can be sealed better, since for one thing it makes no or only very small transverse movements and hence no significant radial mechanical loadings act upon the seal and secondly it offers a greater sealing area.

The second roller may usefully be supported on the free end of the pistonrod.

For the achievement of the necessary accelerations the pressure-fluid cylinder should be operated by compressed air. But at the same time a hydraulic execution is naturally also conceivable.

In order to guarantee that the cable or chain pull always remains under tension and the passenger carrier is not "catapulted" beyond its upper end position, a first storage tank is provided, which may be filled with fluid at a certain pressure in dependence upon the state of loading of the passenger carrier and switched over to the pressure-fluid cylinder for raising the passenger carrier from its lower end position up to its upper end position. For this purpose a measuring and regulating device measures the state of loading of the passenger carrier and controls a regulator valve which switches over a source of fluid to the storage tank.

As an alternative or in addition to this, a number of pressure-limiting valve units may be provided, which are respectively set at different pressures below which they open automatically, whilst a measuring and regulating device measures the state of loading of the passenger carrier and switches over to the storage tank one pressure-limiting valve unit selected in dependence upon the measured state of loading, so that it opens if the pressure in the storage tank exceeds the set value, whereby the pressure in the storage tank may be kept at the desired value in dependence upon the state of loading of the passenger carrier. The storage tank consequently forms a store of energy for the upwards motion of the passenger carrier. If the storage tank is switched over to the fluid pressure cylinder or the interposed valve is opened, the pressure in the storage tank looks after a rapid acceleration during the upwards motion of the passenger carrier, whereby the sensation of a "blast-off" is imparted. But alternatively it is also conceivable to realize a gentle upwards motion of the passenger carrier, that is, without greater acceleration, for which purpose the storage tank is then switched over to the pressure-fluid cylinder via a reducing-valve.

The brake mechanism already mentioned earlier for braking the passenger carrier during its downwards motion may preferably exhibit a controlled brakevalve for the controlled emptying of the fluid, which is connected to that end of the pressure fluid cylinder towards which the piston moves during the downwards movement of the passenger carrier. That is, there arises between that end of the pressure fluid cylinder and the piston a pressure fluid cushion which brakes the piston and the second roller and hence the passenger carrier hanging on the cable or chain pull to correspond. The pressure in this pressure fluid cushion may be controlled by letting out pressure fluid by means of the brake valve and in particular kept to a value which allows a "resilient" braking, so that the piston only comes to rest when the passenger carrier has reached its lower end position.

In a further execution particularly preferred at present, the piston in the pressure-fluid cylinder may be acted upon by fluid from both sides. Consequently it is a question here of a double-acting pressure fluid cylinder. If the one face of the piston is acted upon by pressure fluid, this brings about an upwards motion of the passenger carrier, so that this particular face of the piston acts as a driving mechanism or part of it. If on the contrary the other face of the piston is acted upon by pressure fluid, it brings about an acceleration of the passenger carrier during its downwards motion, so that that face acts as an accelerator mechanism or part of it.

But since in certain states of operation, especially during the upwards motion of the passenger carrier and during free fall a braking action is not required, the pressure-fluid cylinder should preferably exhibit an outlet valve at each end, which is energized to correspond.

The accelerator mechanism already mentioned earlier for the acceleration of the passenger carrier during its downwards motion should preferably exhibit a second storage tank which may be filled with fluid and switched over to that end of the pressure-fluid cylinder from which the piston moves away during the downwards movement of the passenger carrier.

The previously mentioned first and/or second storage tank as well, if necessary, as a third storage tank which is connected between a source of pressure fluid and the pressure-fluid cylinder and may be provided as an ordinary stock tank, may usefully be arranged round the circumference of the pressure-fluid cylinder, whereby a particularly compact construction results. In the case of this execution the storage tank is preferably formed between the jacket of the pressure-fluid cylinder and an outer sleeve arranged at a radial distance from the latter.

In order from the previously explained considerations to keep the centre of gravity as low as possible, the pressure-fluid cylinder should be fastened by the upper portion of it to the lower half of the frame, that is, preferably by its top end to the top end of the lower half of the frame whilst the second roller is supported to be able to move in the upper half.

Again, for better utilization of space the pressure-fluid cylinder should be arranged inside the frame.

Finally it is furthermore a problem of the present invention to impart a travel sensation which is new compared with the hitherto known ride systems of the kind mentioned initially.

In accordance with a further aspect of the present invention this is achieved by a control device being provided for controlling the driving mechanism and the brake mechanism in such a way that in a first mode of operation the driving mechanism imposes a relatively high acceleration upon the passenger carrier during its motion from its lower end position up to its upper end position, and later the brake mechanism slows down the whole downwards motion of the passenger carrier from its upper end position into its lower end position, and in a second mode of operation the driving mechanism imposes a relatively low acceleration upon the passenger carrier during its motion from its lower end position up to its upper end position, and later the passenger carrier during its downwards motion from the upper end position is first of all let fall freely and then braked by the brake mechanism into the lower end position.

Preferably the control device switches on the first and second modes of operation alternately.

For the case where the accelerator mechanism already mentioned above for acceleration of the passenger carrier during its downwards motion, has been provided in addition, in the second mode of operation, at the start of the downwards motion of the passenger carrier the accelerator mechanism should be activated briefly before the free fall starts, and subsequently the free-fall motion is braked to rest in the lower end position.

BRIEF DESCRIPTION OF THE DRAWINGS

A preferred embodiment is explained in greater detail below with the aid of the attached Figures. There is shown in.

DETAILED DESCRIPTION OF THE DRAWINGS

Figure 1:
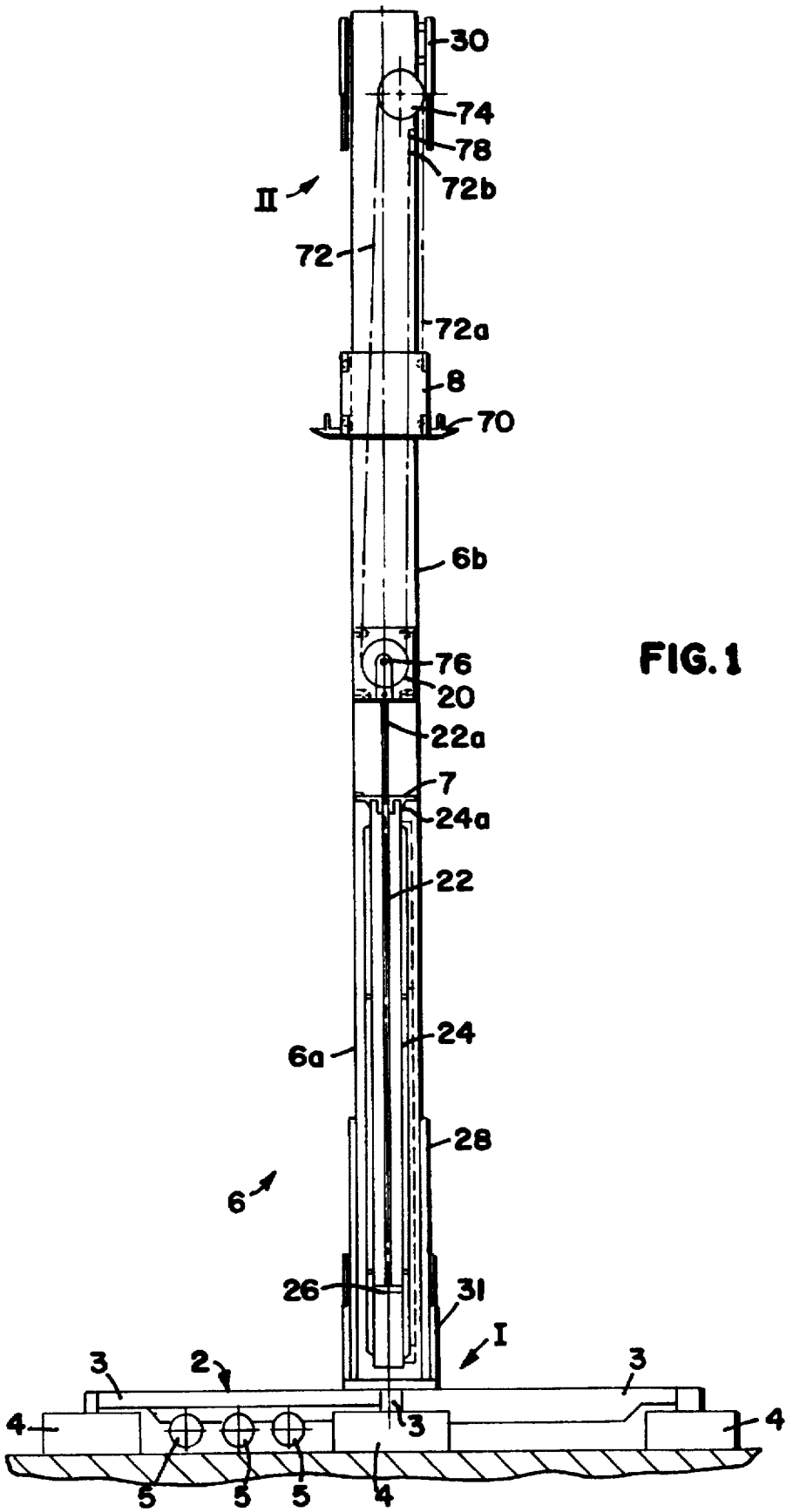
FIG. 1—a diagrammatic side elevation of a preferred embodiment of the ride system.

The ride system represented diagrammatically in FIG. 1 exhibits a base frame 2 provided with outriggers 3 which may be swung out and are jacked up upon a foundation at their free ends by posts or trestles 4. The base frame 2 of the execution shown forms a travelling chassis and is accordingly provided with supporting wheels 5 which in the jacked up state are lifted from the foundation as shown in FIG. 1. Instead of the transportable or travelling execution as shown it is naturally also conceivable to mount the ride system in a stationary manner—for example, in leisure parks—for doing which the supports or trestles 4 are anchored firmly in the foundation (naturally in the case of this execution the supporting wheels 5 are then omitted).

From the base frame 2 a tower 6 rises vertically, which in the transportable execution shown is subdivided into a lower half 6*a* and an upper half 6*b*. At the point of separation 7 the two halves 6*a* and 6*b* of the tower 6 are connected rigidly together but detachably from one another. By means of a device which is not shown the two halves 6*a* and 6*b* of the tower 6 may be separated from one another; this may be done, for example, by means of a folding mechanism (not shown) and/or a crane. For reasons of weight the tower consists of a grid construction (not recognizable in detail in the Figures).

For altering its height a passenger carrier 8 is guided up the tower 6 between a lower end position I and an upper end position II. In the execution shown the passenger carrier 8 has the form of a box open top and bottom, its inner cross-sectional dimensions being adapted to the outer cross-sectional dimensions of the tower 6. The passenger carrier 8 bears against the outside of the tower 6 by means of rollers which may be recognized in FIG. 1 but are not more closely designated, those rollers being guided in vertical rails provided on the outside of the tower 6, though not shown in greater detail in the Figures. Passenger seats 10 are fitted on the outside to the lower portion of the passenger carrier 8.

The passenger carrier is suspended on a cable 12 indicated in dotted line in FIG. 1. The cable 12 may have any cross sectional shape; circular cross-sections or—after the style of a belt—rectangular cross-sections are preferred. Any suitable material is also conceivable, especially steel or high-strength synthetic fibres. Naturally a chain may also be employed as an alternative. The dimensioning of the cable 12 and the choice of material are naturally determined by the loading to be expected. The cable 12 is fastened at its first end 12*a* to the passenger carrier 8 and runs along the outside of the tower 6 up to a first roller 14 supported to be able to turn at the top end of the tower 6, and is there deflected through about 180° downwards in the direction of second roller 16 which is arranged below the first roller 14 and is supported inside the tower 6 for altering its height and so as to be movable transversely to its axis of rotation. From the second roller 16 the cable 12 is deflected upwards again through about 180° and ends with its second end 12*b* at a point of attachment 18 where it is fastened to the tower 6. Hence in the embodiment shown the cable 12 runs between the two rollers 14 and 16 and the point of attachment 18 inside the tower 6. The first roller 14 and the point of attachment 18 are arranged adjacent to or in the region of the upper end position II of the passenger carrier 8.

Whilst the first roller 14 is supported in a fixed position at the top end of the tower 6, the second roller 16 lying below it is supported inside the tower 6 for altering its height. For this purpose a guide-cage 20 is provided, upon which the second roller 16 is supported so as to be free to turn and is guided inside the tower 6 for altering its height. The guide-cage 20 is adapted by its outer cross-sectional dimensions in the inner cross-sectional dimensions of the tower 6 and exhibits rollers lying on the outside, which may be recognized diagrammatically in FIG. 1 but are not designated in detail and by which the guide-cage 20 is guided against the inside of the tower 6, preferably in vertical rails provided for that.

The guide-cage 20 carrying the second roller 16 is fastened to the free end 22*a* at the top of a piston rod 22 which extends downwards in the direction longitudinal to the tower 6 and is led into a compressed air cylinder 24 where it seats against a piston 26 supported to be able to slide inside the compressed air cylinder 24 in the direction longitudinal to the tower 6.

The stroke of the piston 26 in the compressed air cylinder 24 and hence of the second roller 16 amounts in the execution shown to half the stroke of the passenger carrier 8, the length of the cable 12 being adapted to correspond.

Because of the arrangement described above, the piston 26 and hence the second roller 16 rigidly connected to it via the pistonrod 22, all on the one hand, and the passenger carrier 8 on the other, move in opposite ways to one another, the passenger carrier 8 moving at twice the speed of the piston 25 and hence of the roller 16. Consequently if the passenger carrier 8 is lying in its lower end position I, the piston rod 22 has been run out completely so that the piston 26 is lying at the top end of the compressed air cylinder 24 and hence the second roller 16 is lying in the top end of the tower 6 shortly below the first roller 14. For the upwards motion of the passenger carrier 8 from its lower end position I into its upper end position II, the piston 26 is moved downwards in the compressed air cylinder 24, so that the pistonrod 22 is run into the compressed air cylinder 24. If the passenger carrier 8 is now lying in its upper end position II, the piston rod 22 has been run in completely, so that the piston 26 is lying in the pressure cylinder 24 adjacent to its bottom end and the guide-cage 20 with the second roller 16 is lying adjacent to the top end 24*a* of the compressed air cylinder 24.

The compressed air cylinder 24 extends essentially over the whole length of the lower half 6*a* of tower 6 and is suspended by its top end 24*a* from the top end of the lower half 6*a* of the tower 6 below the point of separation 7. Consequently the pistonrod 22 extends by its upper free end 22*a* into the upper half 6*b* of the tower 6 in which the guide-cage 20 is, exclusively guided.

For transport the guide-cage 20 with the second roller 16 supported on it is removable from the free end 22*a* of the piston rod 22, so that the guide-cage 20 and cable 12 remain in the upper half 6*b* of the tower 6. Before the separation of the upper half 6*b* of the tower 6 from its lower half 6*a* it should consequently be useful to run the passenger carrier 8 up into the upper half 6*b* of the tower 6.

On the lower portion of the lower half 6*a* of the tower 6 an additional brake mechanism 28 is provided, by which the downwards motion of the passenger carrier 8 is slowed down until resting in its lower end position I. Nevertheless this brake mechanism 28 which for the rest is only indicated diagrammatically in FIG. 1, only comes into use in emergency. The brake mechanism employed in normal operation is explained in greater detail below with the aid of FIG. 2.

At the top and bottom ends of the tower 6 are fitted respective shock absorbers 30 and 31 which are there to catch the passenger carrier 8 in its end positions I, II.

Figure 2:
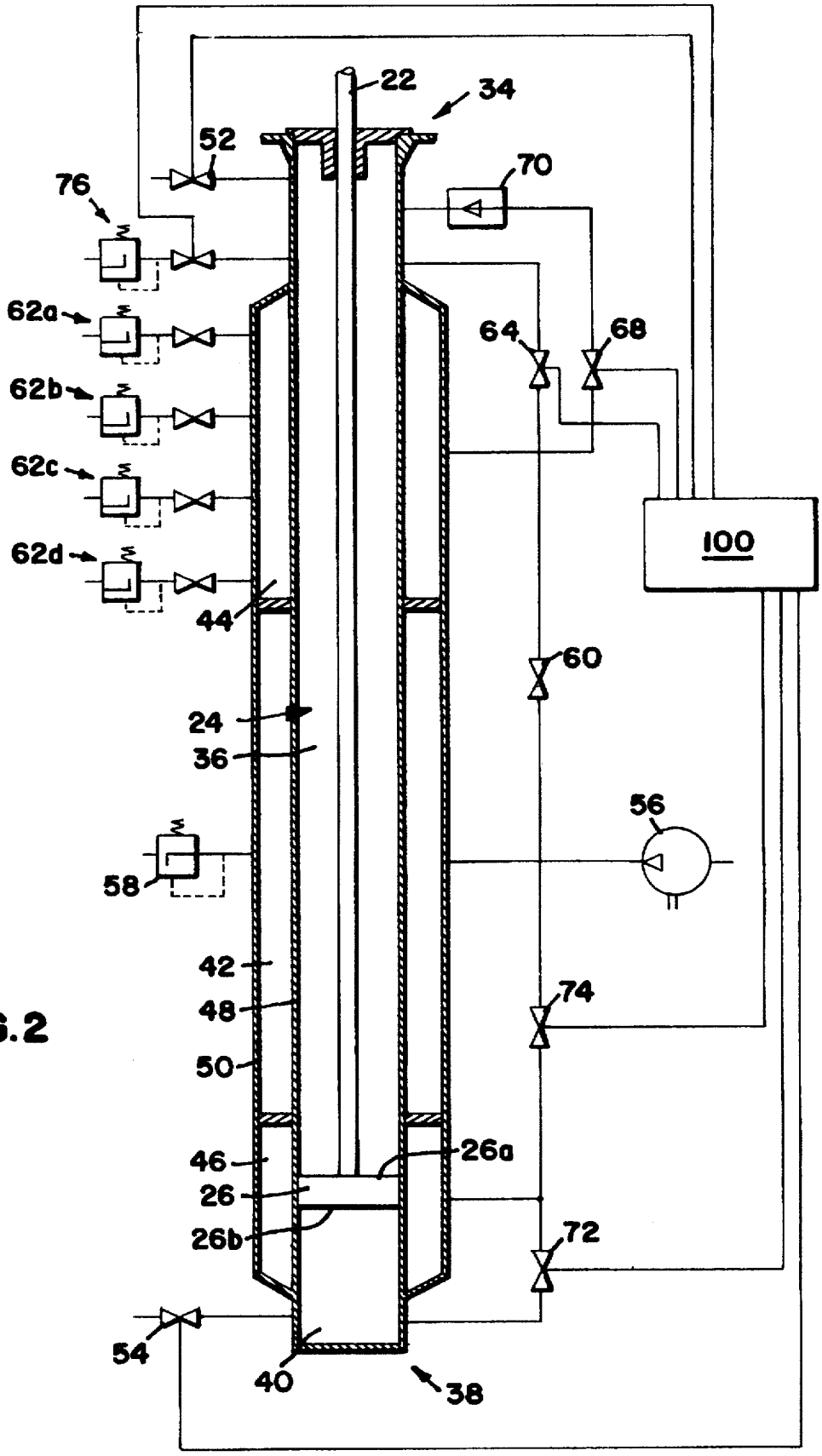
FIG. 2—a preferred execution of a pneumatic circuit with an arrangement of compressed air cylinder and compressed air tank represented in longitudinal section.

In FIG. 2 the compressed air cylinder 24 is shown diagrammatically in longitudinal section on a larger scale as well as an associated pneumatic circuit.

As FIG. 2 reveals, in the case of the compressed air cylinder 24 represented it is a question of a so called double-acting cylinder in which the piston 26 may be acted upon at option by compressed air not only against its upper face 26*a* but also against its underside 26*b*. For this purpose there is formed firstly between the upper endface 34 of the compressed air cylinder 24 through which the piston rod 22 is led in a seal, and the opposite upper face 26*a* of the piston 26, an upper cavity 36, and secondly between the lower endface 38 and the opposite underside 26*b* of the piston 26 a lower cavity 40. Both cavities 36 and 40 can consequently contain or be filled with compressed air, as is explained in greater detail below.

The compressed air cylinder 24 is surrounded at its circumference by a storage tank 42. Above the storage tank 42 the compressed air cylinder 24 is surrounded by a socalled launch-tank 44 and below the storage tank 42 by a socalled free-fall tank 46. For this purpose the compressed air cylinder 24 is surrounded at a radial distance from its jacket 48 by a closed outer sheath 50, so that between the outer sheath 50 and the jacket 48 of the compressed air cylinder 24 are formed the storage tank 42, the launch-tank 40 and the free-fall tank 46, these three tanks 42, 44 and 46 being separated pneumatically from one another.

Since because of its double-acting construction the compressed air cylinder 24 is closed at both its endfaces 34 and 38, corresponding upper and lower vent-valves 52 and 54 are provided there.

The feed-tank 42 is supplied from a compressor 56 which is connected to a source of compressed air (not shown). An overpressure valve 58 is connected to the feed tank 42, the pressure in the feed-tank 42 being thereby limited to a certain value. The feed-tank 42 serves in the usual way as an energy store.

The launch-tank 44 is connected to the compressor 56 via a regulator valve 60. When the regulator valve 60 is opened the launch-tank 44 is charged with compressed air.

Figure 3:
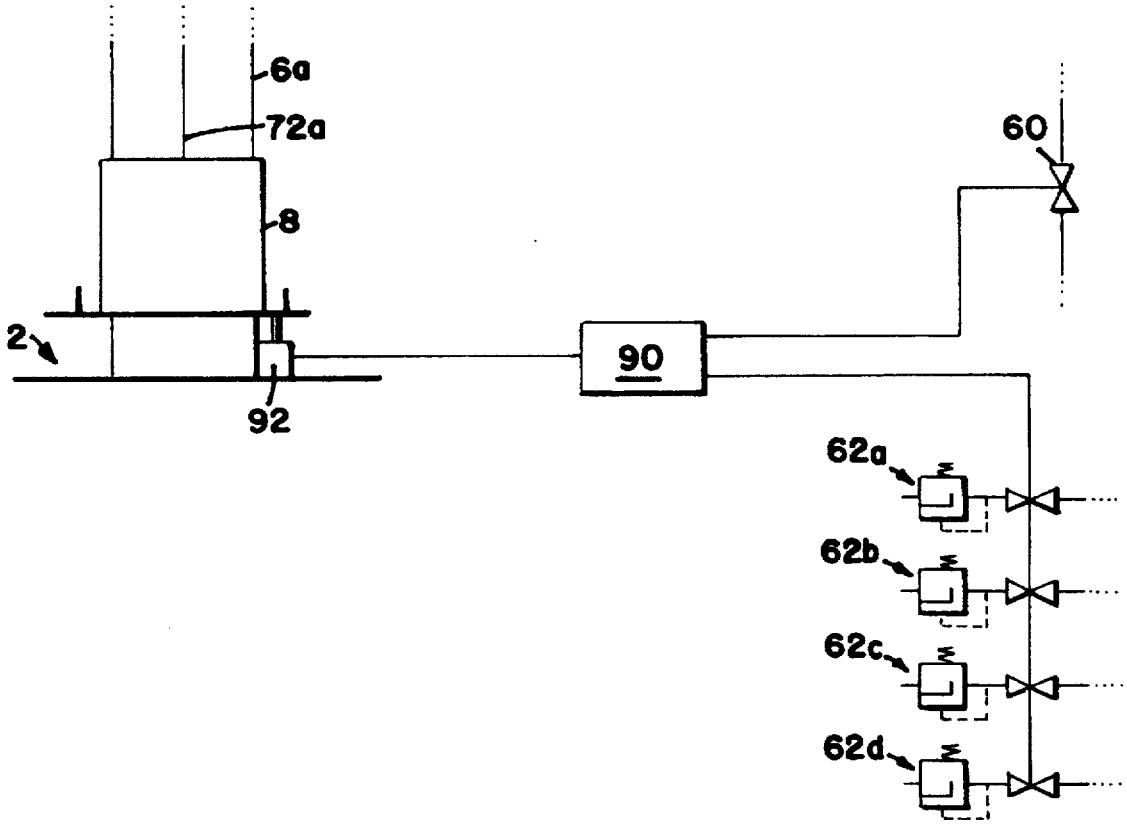
FIG. 3—diagrammatically a measuring and regulating device for detection of the state of loading of the passenger carrier and the setting of valves.

Thereupon a measuring and regulating device represented diagrammatically in FIG. 3 measures the state of loading of the passenger carrier 8 and opens the regulator valve 60 until in the launch-tank 44 the pressure has risen to a suitable value with respect to the state of loading of the passenger carrier 8. For this purpose a sensor 92 is provided, which determines the state of loading of the passenger carrier 8 in its lower end position (cf. FIG. 1) and transmits a corresponding signal over a control lead (not designated more closely in FIG. 3) to the measuring and regulating device 90 which again in dependence upon this signal sets the regulator valve 60 accordingly, over another control lead (not designated more closely in FIG. 3).

The regulating valve 60 is then closed.

For reasons of safety further pressure-limiting valve units 62*a* to 62*d* are connected to the launch-tank 44, each consisting of an opening-valve and an over-pressure valve and being set for different pressures. In dependence upon the state of loading the measuring and regulating device 90 only activates that pressure-limiting valve unit which is set at a value which is suitable in respect of the ascertained state of loading of the passenger carrier 8. If this value is exceeded, the overpressure valve opens the activated pressure-limiting valve unit, whereby the pressure in the launch-tank 44 is held constant at this value. When the pressure drops back below this value, the corresponding overpressure valve closes. The measuring and regulating device 90 is accordingly connected over further control leads (not designated more closely) to the pressure-limiting valve units 62*a* to 62*d*, as revealed in FIG. 3.

The launch-tank 44 serves to make energy available for the upwards motion of the passenger carrier 8 from its lower end position I into its upper end position II. For doing this the launch-tank 44 is connected via a valve 64 to the upper cavity 36 in the compressed air cylinder 24. When the valve 64 is opened, the piston 26 is lying in an upper position near the upper endface 34 of the compressed air cylinder 24, so that the upper cavity 36 exhibits a comparatively small volume. Through the essentially jerky opening of the valve 64 the pressure in the upper cavity 36 rises with a jump, whereby a sharp starting acceleration of the piston 26 in the direction of the lower endface 38 of the compressed air cylinder 24 results. In this way the passenger carrier 8 at the start of its upwards motion is accelerated very strongly out of its end position I, so that to the passengers is imparted an impression of a "blast-off". In order that during its downwards motion the piston 28 is not impeded by the air lying in the lower cavity 40, the lower vent-valve 54 is opened before opening the valve 64.

The previously described setting of the pressure of the compressed air stored in the launch tank 44 in dependence upon the state of loading of the passenger carrier 8 is necessary in order to avoid the passenger carrier 8 shooting out beyond its upper end position II and then being braked abruptly by the upper shock absorbers 30. On the contrary the pressure stored in the launch tank 44 is so dimensioned that the pressure in the upper cavity 36 is nearly relaxed when the passenger carrier 8 has reached its upper end position II.

Instead of a "blast-off"-like upwards motion the passenger carrier 8 may alternatively also be moved slowly, that is, at comparatively low speed and comparatively low or no acceleration from its lower end position I up to its upper end position II. For this state of travel the valve 64 remains closed and the launch tank 44 is connected via a valve 68 and a reducing-valve 70 connected in series, to the upper cavity 36 of the compressed air cylinder 24. In that case the reducing-valve 70 sees to an approximately constant flow of the compressed air out of the launch tank 44 into the cavity 36 so that there only a relatively low static overpressure builds up.

After the passenger carrier 8 has reached its usher end position II, the piston 26 is lying inside the compressed air cylinder 24 in its lower end position; the piston 26 is shown in this position in FIG. 2.

For the succeeding downwards motion of the passenger carrier 8 the piston 26 leaves its lower end position and is moved upwards again in the direction of the upper endface 34 of the compressed air cylinder 24. In order that in doing so the compressed air lying in the upper cavity 36 does not form any braking cushion, the upper vent valve 52 is opened for this.

If the passenger carrier 8 is then to fall free at least in stages, with the passenger carrier 8 pulling the piston 26 after it via the cable 12 because of the influence of gravity, the lower vent valve 54 may be opened for this or remain open so that now air is sucked in from outside into the lower cavity 40.

But because of the increased friction which might impede the start of the free fall, it is useful to blow compressed air into the lower cavity 40 which in the lower end position of the piston 26 has a comparatively small volume, for which purpose the vent-valve 54 remains closed at least at first. The lower cavity 40 obtains the needed compressed air from the free-fall tank 46 which for this purpose is switched in via a valve 72. The free-fall tank 46 has previously been charged from the compressor 56 which may be connected up via a valve 74. Through the compressed air blown essentially in a blast from the free fall tank 46 into the lower cavity 40 of the compressed air cylinder, the piston 26 obtains adequate initial acceleration whereby the passenger carrier 8 already arrives in the state of free fall shortly after leaving its upper end position II.

During the further downwards motion of the passenger carrier 8 and the upwards motion of the piston 26 in the compressed air cylinder 24 connected therewith, the compressed air in the lower cavity 40 relaxes, whereby the acceleration decreases, whilst the continued free fall motion of the passenger carrier 8 is maintained. At this moment in time the lower vent valve 54 may then be opened again.

During continued upwards motion of the piston 26 in the compressed air cylinder 24 the upper vent valve 52 is then closed so that now in the upper cavity 36 of the compressed air cylinder 24 an air cushion is built up with pressure becoming higher, which brakes the further upwards motion of the piston 26 until a brake valve unit 76 connected to the cavity 36 is activated, whereby the passenger carrier 8 is deliberately braked during its further downwards motion, so that it comes to rest in its lower end position I.

Instead of a free fall the passenger carrier 8 may also be slowed down and hence be moved slowly, that is, with comparatively low speed and acceleration from its upper end position II into its lower end position I. For doing this the energy stored in the free-fall tank 46 is not needed and thus the valve 72 remains closed. The lower vent valve 54 is instead opened, whilst the upper vent valve 52 remains closed, and from the start of the downwards motion of the passenger carrier 8 and hence of the upwards motion of the piston 26 in the compressed air cylinder 24, the brake valve unit 75 activates and controls the escape of air from the upper cavity 36 of the compressed air cylinder 24 in such a way that the air cushion arising there is held at a certain pressure, which brings about the desired slowing down of the downwards motion of the passenger carrier 8.

The control of the valves 52, 54, 64, 68, 72 and 74 as well as of the brake valve unit 76 in the way previously described is taken over by a control circuit which is represented diagrammatically in FIG. 2 as the block 100, the control leads between the control circuit 100 on the one hand and the valves 52, 54, 64, 68, 72 and 74 as well as of the brake valve unit 76 on the other, not being characterized by reference numbers in FIG. 2 for reasons of clarity. Again, certain desired modes of operation may be programmed by the control device 100, in which for the generation of different states of travel during the upwards and downwards motions of the passenger carrier 8 the individual valves become energized in a corresponding differing sequence. In particular the control circuit 100 controls the valves in a first mode of operation in such a way that the passenger carrier 8 during its upwards motion from the lower end position I into the upper end position II experiences a relatively high acceleration, whereby the sensation in travel of a "blast-off" is imparted, and subsequently during its whole downwards motion from the upper end position II into the lower end position I it is slowed down so that the downwards motion of the passenger carrier 8 takes place at relatively low speed and relatively low acceleration. In a second mode of operation the control circuit 100 controls the valves in such a way that during the upwards motion of the passenger carrier 8 it experiences a relatively low acceleration or in the course of the further upwards motion none at all and moves at relatively low speed, but subsequently during its downwards motion is first of all brought into free fall and then braked so that it comes to rest safely in its lower end position I. In this connection the control circuit 100 may now be so programmed that the passenger carrier 8 travels alternately in the first and second modes of operation previously described, whereby a hitherto once only pleasure in the ride is imparted, since accelerated ways of travel whether upwards as a "blast-off" or downwards as a free fall, and delayed or slow ways of travel alternate with one another.

In conclusion it may be remarked that the arrangement shown in FIG. 2 may be operated not only with compressed air but also with hydraulic oil.

I claim:

1. A ride system comprising:

a frame, a first roller supported on the frame, at least one passenger carrier which for altering its height is guided between an upper end position and a lower end position, a rope or chain pull which at its first end is fastened to the passenger carrier and is deflected around the first roller so that the passenger carrier is suspended from the first roller by the rope or chain, a driving mechanism which drives the rope or chain pull for raising the passenger carrier from its lower end position up to its upper end position, at least one second roller which is moved and driven by the driving mechanism essentially transversely to its axis of rotation, the rope or chain running from the first roller to the second roller, there becoming deflected and being fastened by the second end to a point of attachment on the frame, and a release mechanism for releasing the passenger carrier for a downwards movement in free fall, wherein the release mechanism releases the second roller.

2. A ride system as in claim 1, further comprising:

an accelerator mechanism for accelerating the passenger carrier during its downwards movement.

3. A ride system as in claim 2, wherein for the downwards motion of the passenger carrier the accelerator mechanism accelerates the second roller correspondingly along its travel.

4. A ride system as in claim 2, wherein the accelerator mechanism exhibits a second storage tank which is filled with fluid and switched over to that end of the pressure-fluid cylinder from which the piston moves away during the downwards motion of the passenger carrier.

5. A ride system as in claim 4, wherein the storage tank is arranged round the circumference of the pressure-fluid cylinder.

6. A ride system as in claim 1, further comprising:

a brake mechanism for braking the passenger carrier during its downwards movement, so that the passenger carrier comes to rest in its lower end position.

7. A ride system as in claim 6, wherein for the downwards motion of the passenger carrier the brake mechanism brakes the second roller correspondingly along its travel.

8. A ride system as in claim 1, wherein the second roller is in addition supported in a guide-cage which is guided on the frame.

9. A ride system as in claim 1, wherein for altering its height the second roller is supported on the frame to be movable between a lower and an upper end position, and the first roller and the point of attachment of the cable are arranged above the lower end position of the second roller.

10. A ride system as in claim 9, wherein the travel of the second roller runs essentially in parallel with that of the passenger.

11. A ride system as in claim 9, wherein the first roller and the point of attachment of the cable are arranged adjacent to the upper end position of the passenger carrier.

12. A ride system as in claim 11, wherein the stroke of the passenger carrier is about twice the height of that of the second roller.

13. A ride system as in claim 1, wherein the driving mechanism is arranged in the lower portion of the frame.

14. A ride system as in claim 13, in which the frame is subdivided into a lower half and an upper half and the lower and upper halves are connected detachably together, and wherein the driving mechanism is arranged in the lower half.

15. A ride system as in claim 14, wherein the second roller is guided to be movable in the upper half of the frame and may be uncoupled from the driving mechanism.

16. A ride system as in claim 1, wherein the frame is made as a tower.

17. A ride system as in claim 1, in which the driving mechanism exhibits a pressure-fluid cylinder with a piston supported to slide in it, and wherein the piston is provided with a pistonrod which is coupled mechanically to the second roller.

18. A ride system as in claim 17, wherein the second roller is supported on the free end of the pistonrod.

19. A ride system as in claim 17, wherein the pressure-fluid cylinder is operated by compressed air.

20. A ride system as in claim 17, further comprising:

a first storage tank which is filled with fluid at a certain pressure in dependence upon the state of loading of the passenger carrier and switched over to the pressure-fluid cylinder for raising the passenger carrier from its lower end position to its upper end position.

21. A ride system as in claim 20, further comprising:

a measuring and regulating device measures the state of loading of the passenger carrier and controls a regulator valve which switches over a source of fluid to the storage tank.

22. A ride system as in claim 20, further comprising:

a number of pressure-limiting valve units are provided, which are respectively set at different pressures below which they open automatically, and a measuring and regulating device measures the state of loading of the passenger carrier and switches over to the storage tank one pressure-limiting valve unit selected in dependence upon the measured state of loading.

23. A ride system as in claim 20, wherein the storage tank is switched over to the pressure-fluid cylinder via a reducing-valve.

24. A ride system as in claim 20, wherein the storage tank is arranged round the circumference of the pressure-fluid cylinder.

25. A ride system as in claim 24, wherein the storage tank is formed between the pressure-fluid cylinder jacket and an outer sleeve is arranged at a radial distance from the latter.

26. A ride system in claim 17, wherein for controlled emptying of the fluid the braking mechanism exhibits a controlled brakevalve which is connected to that end of the pressure-fluid cylinder towards which the piston moves during the downwards motion of the passenger carrier.

27. A ride system as in claim 17, wherein the piston in the pressure-fluid cylinder is acted upon by fluid from both sides.

28. A ride system as in claim 27, wherein the pressure-fluid cylinder exhibits an outlet valve at each end.

29. A ride system as in claim 17, further comprising:

a third storage tank connected between a source of pressure fluid and the pressure-fluid cylinder is arranged round the circumference of the pressure-fluid cylinder.

30. A ride system as in claim 17, wherein the pressure-fluid cylinder is fastened by the upper portion of it to the lower half of the frame.

31. A ride system as in claim 30, wherein the pressure-fluid cylinder is fastened at its top end to the top end of the lower half of the frame and the second roller is supported to be able to move in the upper half.

32. A ride system as in claim 17, characterized in that the pressure-fluid cylinder is arranged inside the frame.

33. A ride system, especially as in claim 1, further comprising:

a brake mechanism for generating a braking action upon the passenger carrier during its movement from its upper end position down to its lower end position, comprising a control device for controlling the driving mechanism and the brake mechanism in such a way that in a first mode of operation the driving mechanism imposes a relatively high acceleration upon the passenger carrier during its motion from its lower end position up to its upper end position, and later the brake mechanism slows down the whole downwards motion of the passenger carrier from its upper end position into its lower end position, and in a second mode of operation the driving mechanism imposes a relatively low acceleration upon the passenger carrier during its motion from its lower end position up to its upper end position, and later the passenger carrier during its downwards motion from the upper end position is first of all let fall freely and then braked by the brake mechanism into the lower end position.

34. A ride system as in claim 33, wherein the control device switches on the first and second modes of operation alternately.

35. A ride system as in claim 33, wherein in the second mode of operation, at the start of the downwards motion of the passenger carrier the control device activates the accelerator mechanism briefly.

* * * * *